US005326383A

United States Patent [19]

Harris

[11] Patent Number: 5,326,383

[45] Date of Patent: Jul. 5, 1994

[54] SUCTION CLEANING SYSTEMS

[75] Inventor: Keith C. Harris, Junortoun, Australia

[73] Assignee: Spoutvac Manufacturing Pty Ltd, Victoria, Australia

[21] Appl. No.: 934,505

[22] PCT Filed: Apr. 9, 1991

[86] PCT No.: PCT/AU91/00133

§ 371 Date: Dec. 2, 1992

§ 102(e) Date: Dec. 2, 1992

[87] PCT Pub. No.: WO91/15146

PCT Pub. Date: Oct. 17, 1991

[30] Foreign Application Priority Data

Apr. 10, 1990 [AU] Australia ..... PJ9575

[51] Int. Cl.[5] ..... B01D 45/12; B01D 47/02

[52] U.S. Cl. ..... 55/248; 55/223; 55/256

[58] Field of Search ..... 55/85, 95, 233, 244, 55/246, 248, 256, 257.5

[56] References Cited

U.S. PATENT DOCUMENTS 3,011,966 12/1961 Jahnentz et al. ..... 55/85
3,464,189 9/1969 Mengenthaler ..... 55/257.5 X
3,472,419 10/1969 King ..... 55/257.5 X
3,494,107 2/1970 Sackett ..... 55/223
3,629,994 12/1971 Jones ..... 55/95 X
4,145,198 3/1979 Laule ..... 55/439
4,251,236 2/1981 Fattinger et al. ..... 55/85 X

FOREIGN PATENT DOCUMENTS 3839672 1/1972 Australia .
7531787 7/1987 Australia .
1758588 8/1988 Australia .
4054289 2/1990 Australia .

*Primary Examiner*—Charles Hart
*Attorney, Agent, or Firm*—Knobbe, Martens, Olson & Bear

[57] ABSTRACT

A suction cleaning system comprises a liquid ring pump which draws dirt-laden air into an upstream separator to remove most of the large and small particulate matter. Between the separator and the pump, air having fine particulate matter is fed into a water chamber. In the water chamber a stream of air and water is generated, with the fine matter being entrained in suspension in the water whereby air free of the fine matter can be withdrawn from the chamber by the pump.

10 Claims, 2 Drawing Sheets

SUCTION CLEANING SYSTEMS

The present invention relates to suction cleaning systems and more particularly to suction cleaning systems for the removal in industrial or household debris. Such systems may be used for cleaning silos, industrial ovens or furnaces or other applications involving the removal of large amounts of small solid or particulate matter together with any water or moisture which might also be present.

There is disclosed in International Patent Application No. PCT/AU89/00335 a heavy duty suction cleaning system which may be mounted on a truck or trailer and which comprises a liquid ring air pump, a relatively coarse filter in a suction line upstream of the pump to filter larger particles and larger matter prior to the pump and a separator in a discharge line downstream of the pump for separating from the discharge airstream water and smaller particulate matter discharged from the pump.

In this previously proposed system the relatively coarse filter is incorporated in a tank in which larger matter is accumulated, the fine particulate matter flowing through the filter to the pump. Although the filter does not trap dust and other fine particulate matter, larger size particles are progressively accumulated in the filter and it is necessary for the filter to be cleaned periodically, typically once a week depending on the usage of the system. Failure to clean the filter will result in reduced performance and, ultimately, in blockage. The liquid ring pump is capable of generating very high suction forces and in the event of a significant blockage in the upstream filter the suction generated by the pump can damage certain of the components.

According to the present invention there is provided a suction cleaning system comprising an air pump, first separating means in a suction line leading to the pump for separating substantially all particulate matter from the incoming airstream with the exception of fine particulate matter, second separating means upstream of the pump and downstream of the first separating means for separating the fine particulate matter from the incoming air, said second separating means comprising a water chamber, means for feeding the incoming air and fine particulate matter through the water chamber to generate an air and water stream within the chamber whereby the particulate matter is held in suspension, and means for causing air substantially free from the suspended particulate matter to be withdrawn from the chamber for passage through the pump.

In a preferred embodiment of the invention the water chamber includes baffles which generate at least one circulating stream of air and water, with the incoming air and fine particulate matter being charged into the water to generate the circulating stream.

Preferably, the pump is a liquid ring pump having a water sealing system between a pump rotor and casing and a further separator is downstream of the pump to separate from the discharged air liquid and any particulate matter which may have passed into the pump, separated water being fed from the separator to the pump to replace sealing water discharged from the pump.

An embodiment of the invention will now be described by way of example only with reference to the accompanying drawings in which.

Figure 1:
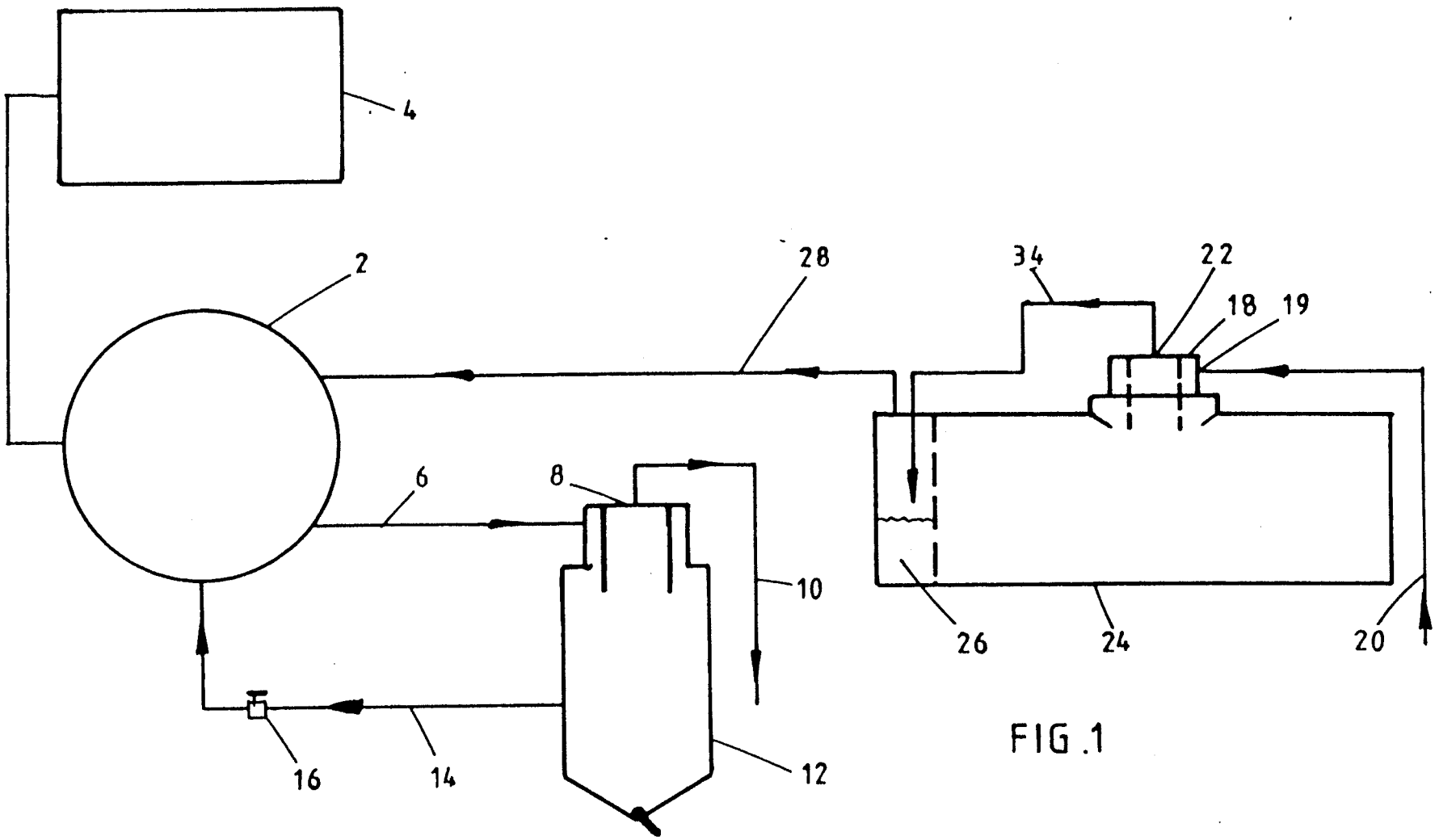
FIG. 1 shows schematically a suction cleaning system in accordance with a preferred embodiment of the invention.

The suction cleaning system in accordance with the preferred embodiment of the invention comprises a pump 2 driven via a motor 4, preferably an internal combustion engine, via a belt drive system. The pump 2 is in the form of a liquid ring pump consisting of a vane rotor eccentrically mounted within a casing. The casing is partially filled with water which, when the rotor is driven, is formed into an annular layer between the inner surface of the casing and the tips of the vanes in order to form a liquid seal between the vanes and the casing without the vanes actually touching the casing. The pump acts as an air suction pump and a pump of this type will not suffer damage if small particles of grit or dust are drawn into the pump with the incoming air. The discharge from the liquid ring pump consists of a stream of air containing droplets of water primarily from the pump sealing system and also any particles of dust or grit which have passed into the pump through the pump inlet. The discharge airstream is fed via a discharge line 6 to a separator 8 in which the water and particulate matter are removed prior to discharge of the cleansed air to atmosphere through an outlet line 10. The separator 8 is preferably a cyclone separator. The separated water and particulate matter collect in a lower tank 12 beneath the cyclone separator 8 with the dust and other particulate matter in the tank 12 separating out of the water as a sludge. A water return line 14 leads from the collecting tank 12 to the pump 2 to replenish sealing water discharged through the outlet of the pump 2, the return line 14 incorporating a valve 16 which is adjustable so that the water flow rate through the return line 14 can be balanced to compensate for the water loss through the pump discharge. The dust and other particulate matter settling in the collecting tank will need to be periodically removed, but this needs only be done infrequently as the system incorporates a separator system upstream of the pump 2 as will now be described and which ensures that almost all of the dust and other particulate matter is removed prior to reaching the pump.

The upstream separator system comprises a further cyclone separator 18. A tangential inlet 19 to the separator 18 is connected to a suction inlet hose 20 and a central outlet 22 of the cyclone separator 18 is connected to the pump inlet via a further separation stage which will be described hereinafter. The cyclone separator 18 is mounted above a large volume receiving tank 24 and the action of the cyclone separator is to cause large, small, and medium size particulate matter and also water to be separated from the incoming airstream, this separated matter being collected in the tank 24. The discharge flow from the cyclone separator 18 through the central outlet 22 consists of air and some fine particulate matter and the further separation stage through which the air passes before reaching the pump 2 removes substantially all of the fine particulate matter whereby the air reaching the pump 2 is either entirely free or almost entirely free of any particulate matter.

Figure 3:
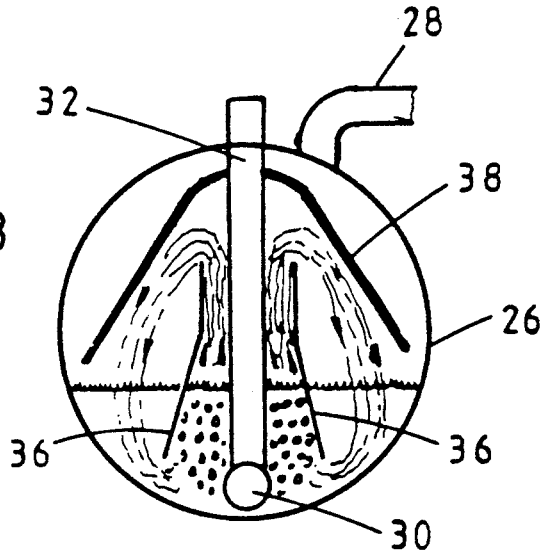
FIG. 3 shows schematically a separating chamber of the upstream separating system.
Figure 4:
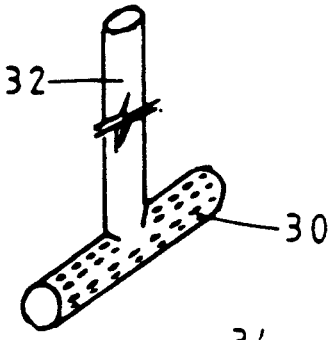
FIG. 4 shows schematically an inlet bubble pipe associated with the upstream separating system.
Figure 2:
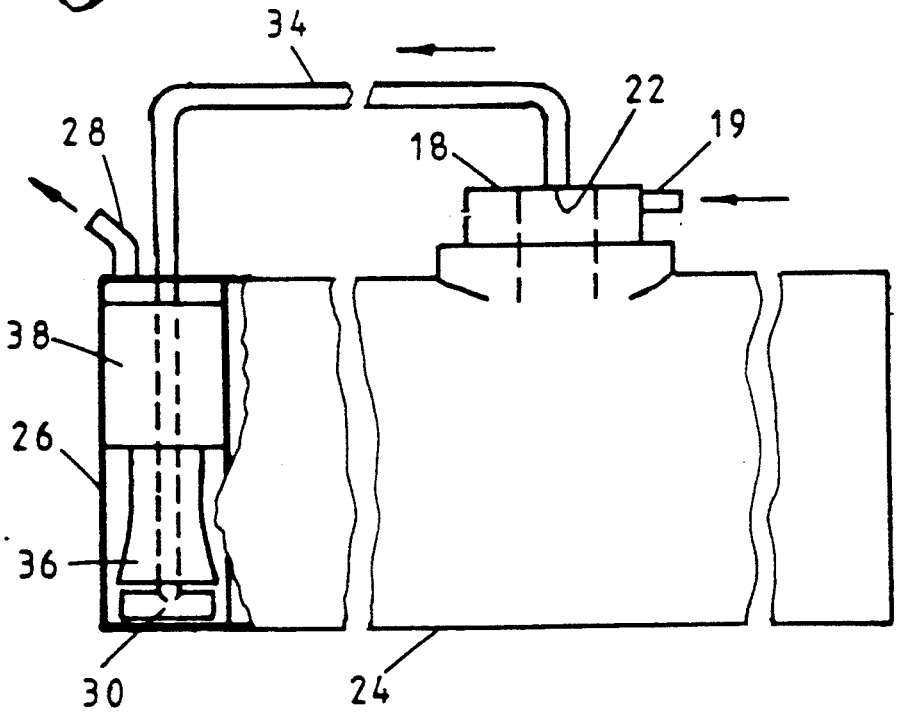
FIG. 2 is a schematic section showing an upstream separating system of the suction cleaning system.

The further separation stage is carried out in a closed cylindrical chamber 26 which for convenience may be constituted by a compartment at one end portion of the collecting tank 24 or alternatively within a separate tank. The further separating chamber 26 is filled to water to about half its depth, and a suction line 28 leads from the upper part of the chamber 26 to the pump 2. A horizontal pipe 30 having rows of apertures in its circumferential wall is mounted towards the bottom of the chamber 26 so as to be submerged within the water. The pipe 30 has an inlet fitting 32 connected via a line 34 to the central outlet 22 of the cyclone separator 18. The pipe 30 lies at the base of a hood defined by two inwardly and upwardly inclined baffle plates 36 which converge towards an outlet spaced above the level of water. The outlet from the hood lies beneath a further baffle plate 38 of inverted V-section, the lower edges of which lie above the water level in the chamber 26. Under the vacuum applied to the interior of the chamber 26 by the pump 2 the air and fine particulate matter discharged from the cyclone separator is discharged from the pipe 30 in powerful streams of bubbles which flow upwardly into the hood. The effect of the hood and the inverted V-section baffle above the hood is to cause two powerful circulating currents of air and water to be generated which flow in opposite rotational directions downwardly beneath the inverted V-section baffle 38 to re-enter the hood at its lower end, as schematically shown in FIG. 3, each current circulating about a respective axis parallel to the axis of the chamber 26. The particulate matter which enters with the air is trapped within these circulating currents as a suspension in the water. The vacuum applied to the chamber 26 has the effect of drawing only air from these circulating currents, the air passing beneath the lower edges of the inverted V-section baffle 38 to be drawn into the upper section of the chamber 26 for passage to the pump 2. This further separation system will operate effectively even as the suspension thickens upon progressive accumulation of fine particulate matter over a period of time and even with relatively infrequent emptying, the air withdrawn from the chamber 26 into the pump will be virtually free of particulate matter. The chamber 26 can contain large amounts of fine particulate matter held in suspension in the water without impeding operation of the system. Periodically, this material is removed as a sludge. Any, particulate matter which might be withdrawn into the pump 2 will be removed by the downstream cyclone separator 8.

With the system described, the air discharge from the outlet line 10 is entirely free from particulate matter even when the system is handling matter containing large amounts of particulate material. The main collecting tank 24 and the chamber 26 can contain significant amounts of material before emptying is necessary.

The embodiment has been described by way of way of example only and modifications are possible within the scope of the invention.

I claim:

1. A suction cleaning system comprising an air pump, first separating means in a suction line leading to the pump for separating substantially all particulate matter from the incoming airstream with the exception of fine particulate matter, second separating means upstream of the pump and downstream of the first separating means for separating the fine particulate matter from the incoming air, said second separating means comprising a water chamber containing a volume of water in a liquid state, means for feeding the incoming air and fine particulate matter into the water chamber in a multiciplicity of fine streams at a position below the liquid water level therein to generate an air and water stream with the chamber above the liquid water level whereby the particulate matter is held in suspension in the water, and means for causing air substantially free from the suspended particulate matter to be withdrawn from the chamber for passage through the pump.

2. A system according to claim 1, wherein the water chamber includes baffle means which generate at least one circulating stream of air and water when the incoming air and fine particulate matter is charged into the chamber.

3. A system according to claim 2, wherein the chamber includes an inlet for said air and fine particulate matter, said inlet being positioned within the chamber at a level beneath a normal water level within the chamber, said inlet being associated with said baffle means to cause generation of the circulating stream.

4. A system according to claim 3, wherein said inlet is a tubular inlet having a plurality of small openings operative to discharge the air and particulate matter into the water in the multiciplicity of streams at positions along the length of the inlet, said baffle means comprising two opposing baffle plates extending upwardly from a position beneath the normal water level, said opposing baffle plates being at opposite sides of the tubular inlet with the inlet being located adjacent the lower ends of the plate, the opposing baffle plates serving to generate two oppositely circulating streams which rise upwardly between the baffle plates and displace in opposite directions over the tops of the respective plates.

5. A system according to claim 4, wherein the baffle means comprises one or more additional baffle plates which define a space into which the upwardly moving streams discharge and which confine said space from above, and the means for causing air substantially free from particulate matter to be withdrawn from the chamber comprises an air outlet leading from the chamber outside of said space.

6. A system according to claim 1, wherein the chamber includes a partition for separating the stream from an upper part of the chamber, said partition being above a normal liquid level within the chamber, and the means for causing air substantially free from particulate matter to be withdrawn from the chamber comprises an air outlet connected to the pump and leading from said upper part of the chamber.

7. A system according to claim 6, wherein the partition has a lower edge above the normal liquid level whereby a passage is defined beneath the lower edge of the partition for flow of air from the stream into the upper part of the chamber.

8. A system according to claim 1, wherein the pump is a liquid ring pump having a water sealing system between a pump rotor and casing and a further separator is downstream of the pump to separate from the discharged air, liquid and any particulate matter which may have passed into the pump, separated water being fed from the separator to the pump to replace sealing water discharged from the pump.

9. A system according to claim 1, wherein the chamber is of cylindrical form and the or each stream circulates about a respective axis parallel to the axis of the cylindrical chamber.

10. A system according to claim 9, wherein the chamber is defined at an end of a collecting tank defining the first separating means.

* * * * *